US006336409B1

(12) United States Patent
Devulder

(10) Patent No.: US 6,336,409 B1
(45) Date of Patent: Jan. 8, 2002

(54) MODULAR RAILWAY RAKE AND A RAILWAY TRAIN MADE UP OF SUCH RAKES

(75) Inventor: Guy Devulder, Estreux (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/492,197

(22) Filed: Jan. 27, 2000

(30) Foreign Application Priority Data

Jan. 27, 1999 (FR) ..... 99 00885

(51) Int. Cl.[7] ..... B61C 3/00

(52) U.S. Cl. ..... 105/26.05; 105/4.1; 105/34.1; 105/49

(58) Field of Search ..... 105/3, 4, 4.1, 26.05, 105/27, 34, 34.2, 49, 61, 244; 318/729, 438, 51, 53, 66, 67, 68

(56) References Cited

U.S. PATENT DOCUMENTS 4,164,188 A * 8/1979 Hallam et al. ..... 105/166

FOREIGN PATENT DOCUMENTS

| | | | | |
|---|---|---|---|---|
| DE | G 94 11 486.2 | | | 10/1994 |
| DE | 0633173 | A1 | * | 1/1995 |
| EP | 0 578 549 | A1 | | 1/1994 |
| EP | 0 630 789 | A1 | | 12/1994 |
| EP | 0 631 917 | A1 | | 1/1995 |
| EP | 0 633 173 | A1 | | 1/1995 |
| WO | WO-97/08803 | A1 | * | 3/1997 |
| WO | WO-99/24304 | | * | 5/1999 |

* cited by examiner

*Primary Examiner*—S. Joseph Morano
*Assistant Examiner*—Frantz F. Jules
(74) *Attorney, Agent, or Firm*—Sughrue Mion, PLLC

(57) ABSTRACT

The rake is made up of at least two vehicles with two levels and includes on-board equipment items including at least one traction motor power supply unit, motive power supply units, auxiliary power supply units and a device adapted to be connected to a power supply network. At least one vehicle includes at least one motor bogie and at least one carrying bogie; at least one carrying bogie of the rake is associated with at least one of said on-board equipment items disposed approximately over it; the ratio between the respective motive power factors of any two groups of two vehicles of the rake is not less than ⅓ and not more than 3. The rake is for carrying passengers.

17 Claims, 2 Drawing Sheets

MODULAR RAILWAY RAKE AND A RAILWAY TRAIN MADE UP OF SUCH RAKES

FIELD OF THE INVENTION

The invention relates to a modular railway rake constituted by modules in the form of so-called "double-decker" vehicles (each having two superposed levels and an intermediate level providing access to the vehicle), and to a railway train made up of such rakes.

More particularly, the object of the invention is to create modular rakes and trains of the above kind which are comfortable for passengers and which, whatever their composition, have masses that are approximately equally distributed along the entire length of the rake or train, performance which is practically identical from one rake or train to another, and a good return on investment for the transport authority.

BACKGROUND OF THE INVENTION

It is known that modular design enables highcapacity rakes and trains to be made up when there is a heavy demand for transport, especially if the modules are of the double-decker type, and avoids the use of rolling stock with a greater capacity than is really needed when demand is low, without this flexibility of operation requiring very high investment by the transport authority. Note that passenger comfort implies that passengers have sufficient room, which requires the ability to increase capacity in a regular manner, i.e. the space available for passengers must be approximately the same in all of the modules.

Also, for the rake or train to have good dynamic behavior, and to limit track wear, axle loads must be as similar as possible; for reasons of reliability and safety, it is also necessary for on-board mechanical or electrical equipment to be operated away from its performance limits (not only in terms of axle load, but also in terms of electrical power transmitted and dissipated, electrical insulation, etc.); such equipment must therefore be distributed in the most appropriate manner, rather than being reduced in quantity and/or in volume without due consideration; the solution generally adopted in the case of single-decker vehicles, which consists in distributing the equipment along the vehicle, for the most part in compartments under the passenger compartment, is inapplicable in the case of double-decker vehicles as it would produce vehicles that are very tall and unstable and that would not fit under existing loading gauges. The equipment must be distributed without unduly affecting passenger capacity, without compromising the comfort of passengers, including the comfort of handicapped passengers, by reducing the space allocated to each of them or by impeding access to the seats and to the various facilities (bar, toilets, baggage space), and without impeding the movement of personnel along the rake; distribution must also be compatible with having different vehicles all based on a single body structure. The invention also aims to solve these problems.

It is also known that adding or removing vehicles can affect the performance of the rakes or trains, because of the resulting variations in motive power, and that this can require the speeds of all the rakes and of all the trains in circulation to match the speed of the slowest rake or train, which is normally the rake or train having the lowest ratio of motive power to load; the invention aims to provide modular rakes and trains which do not suffer significantly from this drawback. Hereinafter, the motive power of a vehicle or a group of vehicles is expressed by a "motive power factor" which is equal to the ratio of the number of driving axles to the total number of axles of the vehicle or of the group of vehicles.

Also, as already mentioned, although modularity keeps down the investment required of the transport authority by offering the ability to match offer quickly to fluctuations in demand by means of a relatively small number of vehicles, reducing the investment required of the transport authority is not the only point to be taken into consideration in order to obtain a good return on investment: given the cost and service life of the vehicles, obtaining a good return on investment also implies good long-term adaptability so that the transport authority can vary its offer at low cost over a long period whenever forecasts turn out to be incorrect, or whenever market or rail infrastructure trends require modification of the rolling stock. It is therefore necessary to ensure that vehicle standardization does not constitute an obstacle to their evolution or to the possibility of deriving a sufficient number of variants from the same body structure to enable the fleet to be adapted at low cost both in the short term and in the long term.

OBJECT AND SUMMARY OF THE INVENTION

The object of the invention is to remedy the drawbacks of prior art rakes and trains and to satisfy the conditions referred to above to the greatest possible extent.

To this end, the invention provides a modular railway rake formed of at least two vehicles with two superposed levels, including at least one bogie including at least one driving axle, at least one bogie including at least one carrying axle, and on-board equipment including at least one power supply electronic unit for supplying motive power to one or more traction motors, at least one motive power supply unit for supplying power to the electronic unit, at least one auxiliary power supply unit for supplying power to auxiliary equipment, and at least one device for connection to an overhead power supply network, in which rake the motive power factor of a vehicle or a group of vehicles is defined as the ratio of the number of driving axles to the total number of axles of the vehicle or group, wherein at least one vehicle includes at least one bogie including at least one driving axle and at least one bogie including at least one carrying axle, at least one bogie of the rake including at least one carrying axle is associated with at least one of said on-board equipment items disposed approximately over that bogie, and the ratio between the respective motive power factors of any two groups of two vehicles of the rake is not less than ⅓ and not more than 3.

By virtue of the above features, a rake including only two vehicles already has the motive power suited to the number of passengers that it can transport and is not largely overpowered, in the usual way, in order to be enable non-motorized vehicles to be added to the original two vehicles, and the total load can be made very similar at most of the bogies, if not all of them.

The rake in accordance with the invention can also have one or more of the following features:

- at least one bogie including at least one driving axle includes two driving axles;
- at least one bogie including at least one carrying axle includes two carrying axles;
- at least one power supply electronic unit is disposed approximately over a bogie including at least one driving axle;
- at least one power supply electronic unit includes at least one inverter and is disposed in the roof of the vehicle;

a rheostatic braking system is disposed approximately over at least one bogie including at least one driving axle;

at least one power supply unit is disposed approximately over a bogie including at least one carrying axle;

at least one motive power supply unit includes at least one electrical transformer;

at least one motive power supply unit includes at least one choke;

at least one bogie including at least one carrying axle is associated with at least one power supply unit and one device adapted to be connected to an overhead electrical power supply network and disposed approximately above that bogie;

it includes at least one interposed vehicle with two superposed levels between two end vehicles and said interposed vehicle includes a bogie including at least one driving axle and a bogie including at least one carrying axle;

the bogie including at least one driving axle of at least one interposed vehicle includes two driving axles;

the bogie including at least one carrying axle of at least one interposed vehicle includes two carrying axles;

it includes another interposed vehicle with two superposed levels between two vehicles and including two carrying bogies;

it includes an interposed vehicle with two superposed levels between two end vehicles and including two bogies, one of which includes two driving axles and the other of which includes at least one driving axle; and it includes an interposed vehicle with two superposed levels between two end vehicles and including two bogies, one of which includes two carrying axles and the other of which includes at least one carrying axle.

Accordingly, adding vehicles between the two end vehicles is accompanied by an approximately proportionate increase in passenger capacity and in motive power, and as from a particular level of motive power, this even allows a non-motorized vehicle to be added without leading to the rake being significantly underpowered.

The invention also provides a railway train including at least two rakes as defined hereinabove connected by removable coupling means.

It is therefore possible to create a high-capacity train from a small number of vehicle designs.

BRIEF DESCRIPTION OF THE DRAWINGS

Other features and advantages of the invention emerge from the following description of embodiments of the invention given by way of non-limiting example and illustrated by the accompanying drawings, in which.

MORE DETAILED DESCRIPTION

Figure 1A:
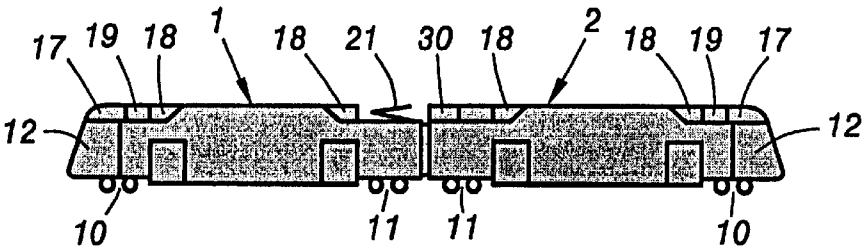
FIGS. 1A and 1B are diagrams showing the layout of the on-board equipment on a two-vehicle rake in accordance with the invention, respectively in side view and in plan view.

The railway rakes in accordance with the invention shown in the figures are double-decker electric rakes (with two superposed levels and an intermediate level). In such railway rakes, apart from the motors, the on-board equipment includes relatively heavy items of equipment and also significantly lighter items of equipment, and the loads per bogie or even per axle can only be made uniform by judiciously distributing the heavy equipment and the lighter equipment. This distribution is facilitated by the presence of axles that are lighter than others, and preferably of bogies that are lighter than others, given that the concept of axle or bogie encompasses, for a driving axle or a motor bogie, the axle or the bogie itself and the motor(s); accordingly, hereinafter, the expression "driving axle" refers to the combination of an axle and its traction motor, the expression "motor bogie" refers to the combination of two driving axles, the expression "carrying axle" refers to an axle with no motor, and the expression "carrying bogies" refers to a bogie with no motor; it follows from the foregoing description that the heavy axles and bogies are the driving axles and the motor bogies and the light axles and bogies are the carrying axles and bogies; half-motor bogies, whose mass is between that of a motor bogie and that of a carrying bogie, include one driving axle and one carrying axle. The heavy equipment above includes: systems such as pantographs for connection to the overhead power supply network, which systems include electrical components with magnetic circuits such as motive power supply equipment including transformers and inductors, since these components form a whole which cannot be subdivided and which it is undesirable to replace with a plurality of components of lower mass; motive power supply electronic units which supply energy from the overhead network to the traction motors in an appropriate form, possibly via respective transformers; auxiliary power supply equipment in particular for powering auxiliary motors; and filter capacitors; this category also includes storage batteries, motor-compressor sets and storage tanks for the fluids used in such sets. The relatively light equipment includes low-voltage cabinets and various electronic control units which can be housed in compartments or pull-out modules which can be located in the low-voltage cabinets, even if they are shown juxtaposed in the drawings to explain the invention.

The invention exploits this disparity of the masses of the different kinds of equipment to load the heavier axles or bogies less heavily than the lighter axles or bogies, wherever possible, for example by reducing to one the number of heavy equipment items disposed approximately above motor bogies.

In some cases, half-motor bogies already allow a better distribution of mass.

Another element to be taken into consideration is the function of the equipment to be distributed, which can usually be classified into one of the following three groups: traction equipment (including the traction motors and their power supply electronic unit), equipment for supplying electrical power to the traction equipment, and pneumatic power supply equipment, given that, to limit transmission lengths within each group (electrical or fluidic), it is not desirable to separate equipment in the same group.

A further element to be taken into consideration is the fact that the number of heavy equipment items and in particular of motive power supply equipment items varies according to the country or countries in which the rake is used, although some of the equipment items are necessarily present on all rakes.

Here the traction motors are of the 3-phase 500 V AC type and this choice imposes transformation of the electrical energy available via the overhead electrical power supply network and transmitted by a connecting device such as a pantograph to obtain this voltage. The motive power supply equipment then generally includes at least one transformer and inductor(s); in particular, since it is necessary to prevent the transmission between the overhead network and the rake of interference induced by or due to switching, at least one choke is included in the power supply equipment.

Additional equipment such as additional transformers may be offered as options, depending on the voltage available from the overhead network. If the rake is to travel in countries in which the network voltages are different, it must be of the dual-voltage or even triplevoltage type.

To be more precise, because the transformation of electrical energy from the network into energy usable by the traction motors requires several steps, since no network delivers three-phase 500 volts, and because the lowest voltage offered by the networks addressed by the present invention is 1500 V DC, or sometimes 3000 V DC, the choice has been made here to supply power to the traction motors of each motor bogie from the output of an inverter power supply electronic unit connected to the 1500 V DC supply or the 3000 V DC supply, as appropriate (alternatively, there can be one unit per traction motor). As auxiliary equipment such as auxiliary motors must be connected to a 3-phase 380 V supply, the choice has also been made here to provide auxiliary power supply equipment including a static converter supplying that voltage and 72 V DC for storage batteries from the 1500 V DC supply or the 3000 V DC supply or from some other available voltage.

Assuming that the rake is required to operate on 1500 V DC networks and on 50 Hz single-phase 25,000 V AC networks, a step-down transformer is provided which is adapted to be connected to the 25,000 V AC supply on the primary side, each secondary winding supplying a forced commutation single-phase bridge delivering a voltage of 1500 V DC to the inverter and to the static converter previously mentioned. Here the forced commutation single-phase bridge is preferably integrated into the power supply electronic unit in the inverter.

If the rake is required to operate at 1500 V DC and at 3000 V DC, a power supply electronic unit, a static converter operating at 1500 V DC and a chopper in an installation converting the 3000 V DC to 1500 V DC are provided.

If the rake is required to operate at 16⅔ Hz single-phase 15,000 V AC, the same transformer can be used as for the 50 Hz 25,000 V AC, provided that it is designed accordingly and includes appropriate taps.

Switching is naturally provided for selecting the corresponding circuits on each change of power supply network.

In addition to the equipment that has just been described, each rake includes various cabinets essentially containing electrical components and electronic components, for example low-voltage cabinets and electronic cabinets which have to be accessible to the driver and to this end are disposed in the cab provided in the rake for the driver, and at least one non-dedicated low-voltage cabinet; it also includes separate air conditioners for the cabs and for the passenger compartments. At least one DC circuit-breaker is provided to disconnect the power supply from the inverters in the event of a current surge or a voltage surge. Motor-compressor sets already referred to and fluid storage tanks supply various fluids under pressure to various devices, for example brakes and cylinders for opening and closing doors, etc.

If it is not possible to return electrical energy that is not used during braking to the power supply network, rheostatic braking devices can dissipate the unused electrical energy.

As indicated, the minimum configuration of a rake in accordance with the invention is made up of two modules, i.e. two vehicles. To standardize the manufacture of the modules and the distribution of loads, the passenger capacities of the two vehicles are similar, and the equipment is divided between the two vehicles, the driving axles being less heavily loaded than the carrying axles, as far as possible, given other constraints, in order for the masses to be correctly distributed in each module and as far as possible in each rake.

Also, as indicated, some equipment is optional, in particular some electrical equipment; optional equipment installed at the request of the transport authority requiring a dual-voltage rake, for example, is as far as possible installed in "habitable" spaces so that their absence enables additional passenger seats to be installed. Equipment of no great height is advantageously accommodated in compartments in the roof in parts of the modules where the seats do not occupy two superposed levels, i.e. near the ends of the modules, approximately over the bogies, in order to remain within the standard loading gauges. As indicated, priority is given in choosing the locations of some items of equipment to limiting the length of connections (electrical or fluid).

The central area of the modules is generally occupied by passenger seats, on the upper deck as well as on the lower deck. The upper decks advantageously offer the same number of seats for all the modules of the same rake; on the other hand, with the same body structure, it is possible to derive modules of various types, for example modules for regional use offering around fifty seats on the upper deck and modules for urban use offering about twenty more seats on the upper deck, through an appropriate layout of the seats, since comfort constraints are less severe for short urban journeys. By virtue of the slightly different layouts in regional modules and urban modules, the difference in passenger capacity between the upper deck and the remainder of the module is greater for regional modules than for urban modules, as more passengers can be accommodated in the end areas of the regional modules, at a level between the upper and lower decks; this is because the doors in urban modules are nearer to the ends than they are in regional vehicles, because in regional vehicles the relatively low height of platforms would make access to the vehicles difficult if the doors were over the bogies, as is made possible by the greater platform height in urban stations, which enables longer uninterrupted passenger compartments in urban modules, on the upper deck as well as on the lower deck.

Figure 1B:
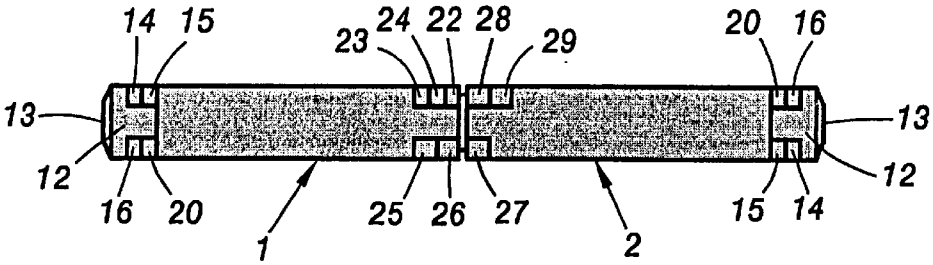

The layout of a regional rake of two vehicles 1,2 connected by removable coupling means, as shown in FIGS. 1A and 1B, is now described. In this rake, the motor bogies 10 are the bogies at the ends of the rake and the bogies of each vehicle near the center of the rake are carrying bogies 11. Each end of the rake is reserved for a cab 12 for the driver which is disposed approximately over the motor bogie and is slightly cantilevered from the chassis of the vehicle, and in which is naturally housed all the equipment which is virtually indispensable in the cab, namely the cab air conditioner 13, its low-voltage cabinet 14, its electronic cabinet 15, and a tackle cabinet 16. Compartments in the roof of the vehicle above the motor bogie house the rheostatic braking device 17, an air conditioner 18 for the passenger compartments, since for efficient air-conditioning each module is equipped with two air conditioners 18 near respective ends of the upper deck, and, in accordance with the invention, a single relatively heavy equipment item, namely the power supply electronic unit 19 which, with the traction motors, forms the motive power equipment of the bogie; the controller 20 of this equipment is housed in the cab; thus most of the "traction" group is grouped together near the cab. Relative to the central longitudinal vertical plane of the rake, the low-voltage cabinet 14 and the electronic cabinet 15 are on one side of the cab and the tackle cabinet 16 and the controller 20 of the power supply electronic unit of the motive power equipment are on the other side; this arrangement leaves an approximately central free space which can be provided with a door giving access to the passenger space.

In contrast, the facing end areas of the two vehicles 1, 2 are not identical to each other, since the equipment is distributed throughout the rake rather than vehicle by vehicle.

Accordingly, one vehicle has on the roof, at the end remote from the cab, i.e. approximately above its carrying bogie, a device(pantograph) 21 connecting the rake to the power supply network; cabinets or compartments in this vehicle 1 house a choke 22, low-voltage equipment 23 and storage batteries 24, on one side of the vehicle, and a 25,000 V transformer 25 and a DC circuit-breaker 26 on the other side, a central corridor providing passage from one vehicle to the other. These cabinets or compartments therefore house the greater part of an "electrical power" group. As already mentioned, a compartment in the roof of the vehicle houses an air conditioner 18 for the passenger compartments. The equipment at this end can be heavier than that at the other end, because the bogie at this end is lighter because it is a carrying bogie. Note that passenger seats are provided near the cabinets, at the intermediate level between the lower deck and the upper deck. Thus if some of the equipment is dispensed with, for example the 25,000 V transformer 25 in the case of a 1500 V or 3000 V single-voltage rake, the corresponding space can be fitted with additional passenger seats.

The end area of the other vehicle 2 opposite the cab houses internally, in compartments, pull-out units or cabinets, depending on their overall size, a controller 27*b* for the static converter on one side of a central corridor and a motor-compressor set 28 and a storage tank 29 on the other side, i.e. most of a "pneumatic energy" group, near which passenger seats are installed; compartments in the roof contain a static converter 30 forming part of the auxiliary power supply equipment and, of course, an air conditioner 18 for the passenger compartments.

In the urban version, the rheostatic braking devices 17 are dispensed with, which lightens the load on the intrinsically heavier motor bogies 10.

Figure 2A:
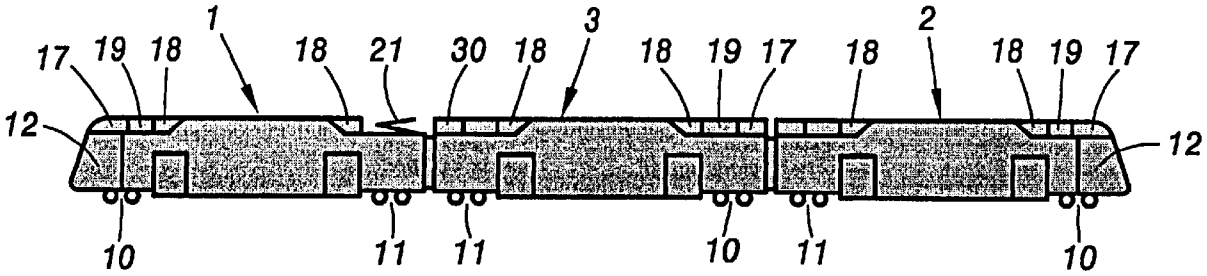
FIGS. 2A and 2B are diagrams showing the layout of the on-board equipment on a three-vehicle rake in accordance with the invention and derived from the rake shown in FIGS. 1A and 1B, respectively in side view and in plan view.
Figure 2B:
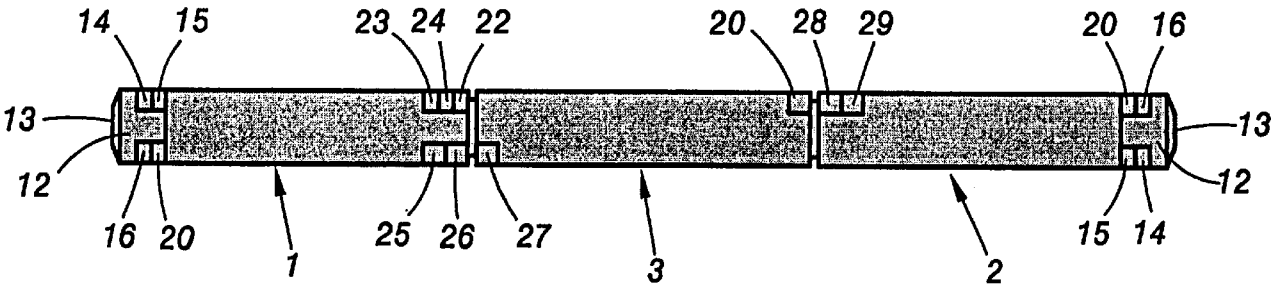

The layout of a rake of three regional vehicles connected by removable coupling means, as shown in FIGS. 2A and 2B, is now described. It is obtained by interposing an additional double-decker vehicle 3 (with an intermediate level) between the two end double-decker vehicles 1, 2. Here the additional vehicle 3 has a motor bogie 10 and a carrying bogie 11, the carrying bogie adjoining the carrying bogie 11 of the end vehicle 1, which is fitted with a pantograph 21.

To facilitate converting a two-vehicle rake into a three-vehicle rake, both end vehicles 1, 2 are the same apart from one modification of one of the two vehicles, in particular to reduce the length of the connections. To be more precise, the static converter 30 which is part of the auxiliary power supply equipment, which was in a roof compartment of one of the end vehicles, is transferred into a roof compartment of the additional vehicle 3, approximately above the carrying bogie, and its controller 27 is transferred into a compartment in the vehicle 3 under the converter; the same end of this vehicle is equipped with seats at the intermediate level. The opposite end of the additional vehicle 3, above the motor bogie 10, also has seats at the intermediate level, because the power supply electronic unit 19 of the motor bogie is in a compartment in the vehicle roof, along with the corresponding rheostatic braking device 17; accordingly, only the controller 20 of the power supply electronic unit is in a compartment of the vehicle 3 near the seats. Of course, two air conditioners 18 are housed in roof compartments, one approximately over the carrying bogie 11 and the other approximately over the motor bogie 10.

In the urban version, the additional vehicle 3 includes the same equipment after the same transformation of an end vehicle, apart from the fact that the motor bogie 10 also supports a low-voltage cabinet; some seats can also be replaced by toilets, for example seats approximately over the motor bogie.

Figure 3A:
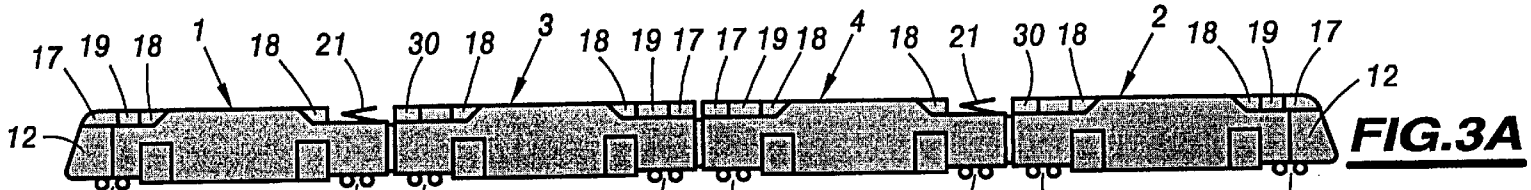
FIGS. 3A and 3B are diagrams showing the layout of the on-board equipment on a four-vehicle rake in accordance with the invention and derived from the rake shown in FIGS. 2A and 2B, respectively in side view and in plan view.
Figure 3B:
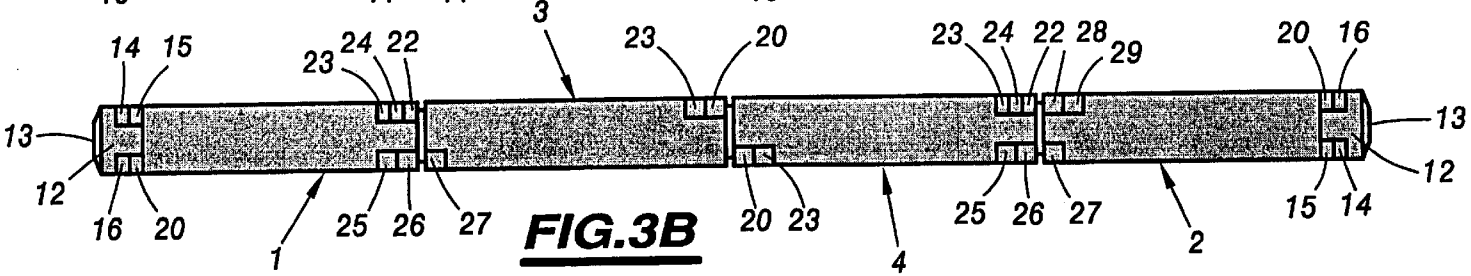

The layout of a regional rake of four vehicles connected by removable coupling means, as shown in FIGS. 3A and 3B, is now described. It is obtained by disposing a further double-decker vehicle 4 between the additional vehicle 3 from FIG. 2 and the end vehicle 2 that was modified to constitute a three-vehicle rake.

Here the further vehicle 4 includes a motor bogie 10 adjoining that of the additional vehicle 3 from FIG. 2 and a carrying bogie 11 adjoining that of the end vehicle 2 which was previously modified; however, that end vehicle is further modified compared to the three-vehicle rake to include a static converter 30 in a roof compartment, as in the rake of two vehicles 1, 2, because the further vehicle 4 includes a device 21 connected to the overhead network approximately over its carrying bogie 11; however, the additional vehicle 3 retains a roof-mounted static converter 30 because it is in the immediate vicinity of a device 21 connected to the overhead network on the roof at the other end vehicle 1, and a low-voltage equipment cabinet 23 is added near the controller 20, approximately over the motor bogie; as already mentioned, the controller 20 can be housed in a compartment integrated into the low-voltage cabinet; on respective opposite sides of a central corridor and approximately over the carrying bogie 11 of the further vehicle 4, as over the carrying bogie 11 of the other end vehicle 1, are a choke 22, a low-voltage cabinet 23, and a storage battery 24 on one side and a 25,000 V transformer 25 and a DC circuit-breaker 26 on the other side; again, if there is a space which is free of equipment because of optional choices made, it can be fitted with seats at the intermediate level. A power supply electronic unit 19 of the traction motors and a rheostatic braking device 17 are housed in roof compartments approximately over the motor bogie 10 and in the vehicle, on respective opposite sides of a central corridor, there are a low-voltage cabinet 23, and the controller 20 of the power supply electronic unit and seats on one side and passenger seats on the other side. There is also an air conditioner 18 for the passenger compartments in a roof compartment approximately over each bogie 10, 11.

In the urban version, as previously, the rheostatic braking devices 17 are dispensed with, along with most of the seats in the end areas, since the end areas of urban vehicles are shorter.

Figure 4A:
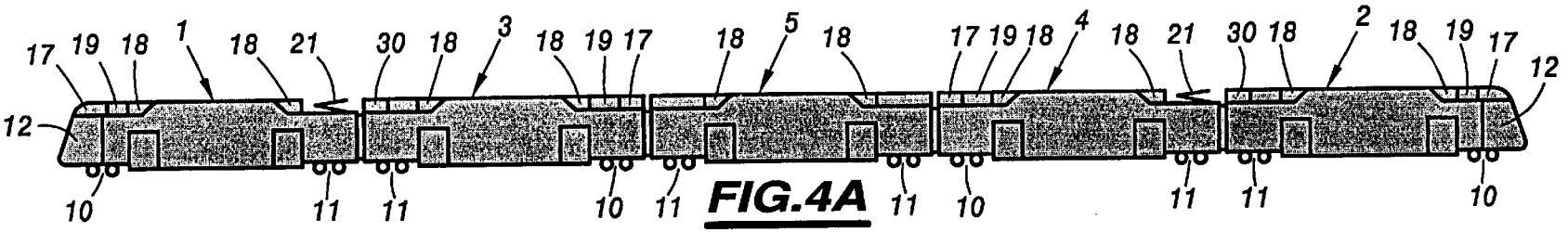
FIGS. 4A and 4B are diagrams showing the layout of the on-board equipment on a five-vehicle rake in accordance with the invention and derived from the rake shown in FIGS. 3A and 3B.
Figure 4B:
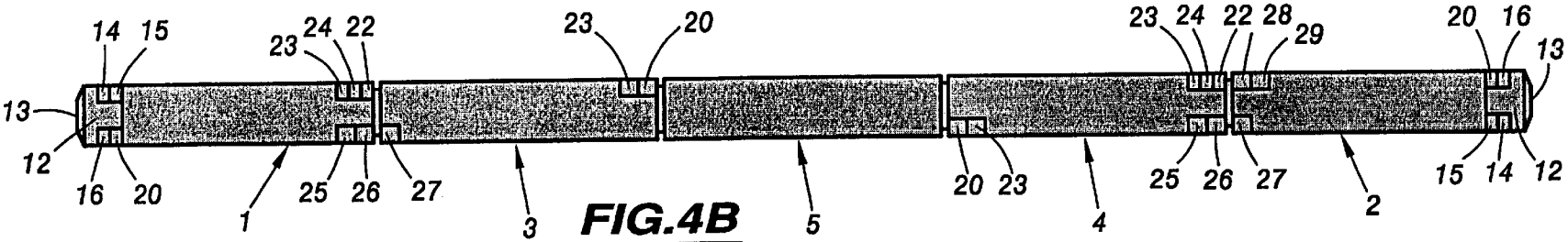

The layout of a regional rake of five vehicles connected by removable coupling means, as shown in FIGS. 4A and 4B, is now described. It is obtained by disposing a module consisting of another vehicle 5 between the additional vehicle 3 and the further vehicle 4 from FIGS. 3A and 3B.

Here the vehicle 5 has two carrying bogies 11, but its presence does not significantly "burden" the operation of the rake, which initially included four vehicles and which was 50% powered. In this case, where there is no motor bogie, the vehicle includes an air conditioner 18 in a roof compartment approximately over each bogie 11; passenger seats are provided inside the vehicle 5, at each end area thereof.

Likewise in the urban version.

It is possible to make up trains of a plurality of coupled rakes connected by removable coupling means such as those just described; for economy and simplicity, a limit of two coupled rakes may be imposed, since with a single rake it is a simple matter, as already mentioned, to make up a train of two to five modules, so that with two rakes it is possible to constitute a train of four to ten modules.

Each vehicle 1, 2, 3, 4 being 50% motorized, here by means of a motor bogie 10 and a carrying bogie 11, avoids the known drawbacks of one or two motorized vehicles constituting an over-powered rake when used with no intermediate vehicle and an under-powered rake when used with a plurality of non-motorized intermediate vehicles; to the contrary there is obtained a rake which is always optimally powered and able to receive an additional nonmotorized vehicle 5 without significant inconvenience.

Of course, the rakes which have just been described are merely examples, but for the motive power to be distributed approximately uniformly along each rake, in accordance with the invention, they are constituted subject to a constraints regarding the motive power factor. As already mentioned, the motive power factor of a vehicle or a group of vehicles is defined as the ratio of the number of driving axles to the total number of axles of the vehicle or group. In accordance with the invention, when making up the rakes, the ratio of the motive power factors of any groups of two vehicles (whether adjacent or not) is within a particular range; to be more precise, according to the invention, the ratio between the respective motive power factors of any groups of two vehicles is chosen not to be less than ⅓ and not more than 3. This condition can even be applied to rakes of two vehicles, noting that it is then possible to consider the same group twice identically with the same motive power factor, and therefore a ratio of the motive power factors equal to 1, which is the case of the rake from FIGS. 1A and 1B in which the two vehicles have a motive power factor equal to ½. In the case of the rakes from FIGS. 2A and 2B and FIGS. 3A and 3B, all the vehicles have a motive power factor equal to ½ and so all the groups of two vehicles have a motive power factor equal to ½ and the ratio of the motive power factors is always equal to 1. For the rake from FIGS. 4A and 4B, in which there is a non-motorized vehicle, the groups of two vehicles have a motive power factor of either ½ or ¼, depending on whether they contain the non-motorized vehicle or not; the ratio of the motive power factors is therefore 1, considering two groups made up of motorized vehicles, and 2 or ½, considering two groups constituted differently and according to whether the motive power factor of the more highly-powered group is in the numerator or in the denominator of the motive power factor ratio. Note that the limiting motive power factors of ⅓ and 3 correspond to the situation in which there are two 50% motorized vehicles, one non-motorized vehicle and one 100% motorized vehicle, for example.

The rakes and trains are always powered approximately in proportion to the number of vehicles in them and therefore to their mass, with the result that there are no slow (because under-powered) rakes or trains affecting the regularity of traffic on the track on which they travel.

The modular design enables the transport authority to react easily to changing requirements by adding an additional vehicle 3, if necessary, an further vehicle 4, and possibly an extra, non-motorized vehicle 5, and by associating two rakes to constitute a train. Moreover, the capacity of each rake can be increased by adding one to three modules 3, 4, 5 without it being simultaneously necessary to remove an existing module from the rake for technical reasons.

This design also enables the transport authority to modify the fleet if demand has initially been under-estimated, by continuing to use the vehicles 1, 2, 3, 4, 5 already in its possession, and minimizing the initial investment of the transport authority expecting growth in the medium term.

Costs are also reduced by the fact that the same body structure is used in constructing all the vehicles of the same train, whether that train is for regional use or for urban use.

As the rakes are not designed as coupled vehicles which have to be autonomous, but as a train set that can include two to five modules in this instance, there is no redundancy of equipment in rakes including four or five modules, and the available equipment is always used optimally.

This design also enables regular distribution of the axle loads, which avoids overloaded axles operating very close to limits authorized by the track infrastructure, with all the attendant drawbacks of this practice.

Also, because most of the equipment that can be dispensed with at the request of transport authorities, given the special circumstances of the their use, is housed in habitable areas, dispensing with them means that the passenger capacity can be increased. The fact that as much of the obligatory equipment as possible is housed in the roofs of the modules means that a maximum amount of space can be reserved for the passenger compartments, this advantage being accentuated in the urban version by the fact that the doors are above the bogies.

Finally, locating the equipment according to its functional domain or group (traction, electrical energy, pneumatic energy) reduces the length of the connections needed to interconnect equipment items within the same group. However, the invention is of course not limited to the embodiments described above and shown, and others can be envisaged without departing from the scope of the invention. In particular, the fifth module of the rake could be a 50% motorized vehicle, for example, like the other four (motive power factor equal to 1), or even one of the elements of any rake already including at least two 50% motorized end vehicles, or a non-motorized or 100% motorized vehicle, which in the case of a rake with three modules would constitute a 33% motorized rake (motive power factor ranging from ½ to 2), or 66% motorized rake (motive power factor ranging from ⅔ to 3/2), respectively; note in this regard that in this case it is in practice necessary for each of the end vehicles to have a pantograph above its carrying bogie; also, it is in practice necessary in the triple-voltage versions with three vehicles to have two pantographs, but in this case it is advantageous for the center vehicle to have the additional pantograph above its carrying bogie.

What is claimed is:

1. A modular railway rake comprising:

a plurality of modular vehicles, each with two superposed levels;

a plurality of bogies with driving axles and carrying axles;

one or more traction motors;

on-board equipment, said on-board equipment comprising at least one power supply electronic unit for supplying motive power to said one or more traction motors, at least one motive power supply unit for supplying power to the electronic unit, at least one auxiliary power supply unit for supplying power to auxiliary equipment, and at least one device for connection to an overhead power supply network, wherein at least one of said plurality of modular vehicles includes at least one bogie of said plurality of bogies with at least one driving axle, and at least one bogie of said plurality of bogies with at least one carrying axle of said carrying axles, and wherein at least one bogie of said plurality of bogies includes at least one of said carrying axles with at least one of said on-board equipment items disposed approximately over that bogie, and wherein the motive power factor of one of the modular vehicles or a group of modular vehicles of said plurality of modular vehicles making up said rake is defined as the ratio of the number of driving axles to the total number of axles of the one modular vehicle or the group of modular vehicles, and the ratio between the respective motive power factors of any two groups of two modular vehicles of the rake is not less than ⅓ and not more than 3.

2. A railway rake according to claim 1, wherein at least one of said plurality of bogies includes two driving axles.

3. A railway rake according to claim 1, wherein at least one of said plurality of bogies includes two carrying axles.

4. A railway rake according to claim 1, wherein at least one of said at least one power supply electronic unit is disposed approximately over a bogic of said plurality of bogies having at least one of said driving axles.

5. A railway rake according to claim 1, wherein at least one of said at least one power supply electronic unit includes at least one inverter and is disposed in the roof of the vehicle.

6. A railway rake according to claim 1, wherein a rheostatic braking system is disposed approximately over at least one of said driving axles.

7. A railway rake according to claim 1, wherein at least one power supply unit is disposed approximately above at least one of said carrying axles.

8. A railway rake according to claim 1, wherein at least one of said at least one motive power supply unit includes at least one electrical transformer.

9. A railway rake according to claim 1, wherein at least one of said at least one motive power supply unit includes at least one choke.

10. A railway rake according to claim 1, wherein at least one power supply unit and one device of said at least one device for connection to an overhead power supply network are disposed approximately above at least one of said carrying axles.

11. A railway rake according to claim 1, including at least one interposed vehicle of said plurality of vehicles with two superposed levels, between two end vehicles of said plurality of vehicles, and said at least one interposed vehicle includes at least one driving axle of said driving axles, and at least one carrying axle of said carrying axles.

12. A railway rake according to claim 11, wherein the at least one interposed vehicle includes two driving axles.

13. A railway rake according to claim 11, wherein the at least one interposed vehicle includes two carrying axles.

14. A railawy rake according to claim 11, including another interposed vehicle with two superposed levels between two vehicles and including two carrying bogies.

15. A railway rake according to claim 1, including an interposed vehicle of said plurality of vehicles with two superposed levels, between two end vehicles of said plurality of vehicles, and including two bogies of said plurality of bogies, one of said two bogies including two driving axles and the other of said two bogies including at least one driving axle.

16. A railway rake according to claim 1, including an interposed vehicle of said plurality of vehicles with two superposed levels, between two end vehicles of said plurality of vehicles, and including two bogies of said plurality of bogies, one of said two bogies including two carrying axles and the other of said two bogies including at least one carrying axle.

17. A railway train including at least two rakes according to claim 1 connected by removable coupling means.

* * * * *